US009303380B2

(12) United States Patent
Lyublinski et al.

(10) Patent No.: US 9,303,380 B2
(45) Date of Patent: Apr. 5, 2016

(54) SYSTEMS FOR CORROSION PROTECTION OF STORAGE TANK SOIL SIDE BOTTOMS

(71) Applicant: NORTHERN TECHNOLOGIES INTERNATIONAL CORPORATION, Beachwood, OH (US)

(72) Inventors: Efim Ya Lyublinski, Solon, OH (US); Gautam Ramdas, Beachwood, OH (US); Yefim Vaks, South Euclid, OH (US); Terry Alan Natale, Hudson, OH (US); Monique Humbert Posner, Shaker Heights, OH (US); Kelly Baker, Spring, TX (US); Alexander Roytman, Solon, OH (US)

(73) Assignee: NORTHERN TECHNOLOGIES INTERNATIONAL CORPORATION, Beachwood, OH (US)

( * ) Notice: Subject to any disclaimer, the term of this patent is extended or adjusted under 35 U.S.C. 154(b) by 0 days.

(21) Appl. No.: 14/514,505

(22) Filed: Oct. 15, 2014

(65) Prior Publication Data

US 2015/0108148 A1 Apr. 23, 2015

Related U.S. Application Data

(60) Provisional application No. 61/892,785, filed on Oct. 18, 2013.

(51) Int. Cl.

| | |
|---|---|
| ***E02D 27/38*** | (2006.01) |
| ***E04H 7/06*** | (2006.01) |
| ***B65D 90/22*** | (2006.01) |

(52) U.S. Cl.

CPC ..... *E02D 27/38* (2013.01); *B65D 90/22* (2013.01); *E04H 7/06* (2013.01); *Y10T 137/7039* (2015.04)

(58) Field of Classification Search

CPC ..... E02D 27/38; B65D 90/22; E04H 7/06; Y10T 137/7039

USPC ..... 220/634, 565, 628, 600, 604, 605, 610; 29/428; 52/741.3, 741.4; 137/376

See application file for complete search history.

(56) References Cited

U.S. PATENT DOCUMENTS

| | | | | |
|---|---|---|---|---|
| 4,290,912 | A | 9/1981 | Boerwinkle et al. | |
| 5,096,087 | A * | 3/1992 | Thomas | B65D 90/501 137/312 |

(Continued)

FOREIGN PATENT DOCUMENTS

| | | | |
|---|---|---|---|
| CA | 1 207 970 | A | 7/1986 |
| WO | 2012 079173 | A1 | 7/2012 |

*Primary Examiner* — Robert J Hicks
*Assistant Examiner* — Kareen Thomas
(74) *Attorney, Agent, or Firm* — Hudak, Shunk & Farine Co. LPA

(57) ABSTRACT

A method and apparatus for the corrosion protection of tank soil side bottoms is achieved by providing equipment to an existing storage tank as by installing a chime delivery system about the perimeter of the storage tank bottom plate, and introducing an appropriate amount of a corrosion inhibitor into the chime delivery system, whereby the corrosion inhibitor is readily admitted into the spaces between the substrate and the tank bottom plate. The system avoids any refurbishment of the tank and allows for easy introduction and replenishment of inhibitor without interruption of tank operations. The system also does not require any renovation of the tank, and does not require any replacement of the tank bottom plate panels.

20 Claims, 2 Drawing Sheets

(56) References Cited

U.S. PATENT DOCUMENTS

| | | | | |
|---|---|---|---|---|
| 5,172,584 | A * | 12/1992 | Thomas | B65D 90/501 220/565 |
| 5,320,778 | A | 6/1994 | Miksic et al. | |
| 5,855,975 | A | 1/1999 | Miksic et al. | |
| 6,099,735 | A | 8/2000 | Kelada | |
| 6,171,029 | B1 | 1/2001 | McGill et al. | |
| 2009/0282754 | A1 | 11/2009 | Watson | |

* cited by examiner

SYSTEMS FOR CORROSION PROTECTION OF STORAGE TANK SOIL SIDE BOTTOMS

CROSS REFERENCE

This application is a conversion application of U.S. patent application No. 61/892,785, filed Oct. 18, 2013, for "Systems for Corrosion Protection of Storage Tank Soil Side Bottoms", which is hereby fully incorporated by reference.

FIELD OF THE INVENTION

The present invention relates to a system for corrosion protection of storage tank soil side bottoms located on a substrate by application of an inhibitor ring delivery system about the periphery of the tank and wherein corrosion inhibitors can be readily admitted via the ring delivery system into the spaces between the substrate and the tank bottom (soil side) to protect the same against corrosion.

BACKGROUND OF THE INVENTION

In aboveground storage tanks, corrosion of soil side bottoms and double bottoms is unpredictable and can reduce the thickness of the tank bottom up to about 5 mm/year. There are multiple tank bottom and foundation designs that address some of the corrosion problems. A typical corrosion protection method, i.e., cathodic protection system, in most cases is not effective due to inherent dry soil conditions at least during some part of a year. The use of soluble corrosion inhibitors, as with cathodic systems, is only viable in fully saturated sand or soil and it is generally difficult to obtain such saturated conditions. Protective coatings cannot be applied to existing or new tank soil side bottoms.

In summary, corrosion of aboveground storage tanks either with a single soil side bottom or a double bottom is a major worldwide problem. Such tanks face unpredictable application and environmental conditions that often cause the bottoms to leak. Polymer protection layers can be damaged or become water permeable over time and result in leaks of the stored product, which can lead to severe environmental impact requiring extensive cleanup activities along with environmental fines and other costs. Moreover, dangerous operating conditions occur when the leaking product is volatile or flammable. Another disadvantage is that repair of tank bottoms generally requires down time.

SUMMARY OF THE INVENTION

An aspect of the present invention is to provide an apparatus and method (e.g. retrofitting) to protect soil side bottoms of either existing or new storage tanks in a quick, generally inexpensive, and convenient manner. Another aspect of the present invention is that the corrosion protection maintains the operation of the existing tank and does not require the same to be taken out of operation. A further aspect of the present invention is that the apparatus and method are readily applied to different designs and sizes of aboveground storage tanks that have soil side bottoms that reside on a substrate at least part of which is typically hard. Yet another aspect of the present invention is that it can be used either as a stand-alone soil side bottom inhibitor delivery system or in combination with other soil side bottom inhibitor delivery systems. Still another aspect of the present invention is that it is applicable to various different environmental and application conditions.

In general, the apparatus and process of the present invention relates to retrofitting aboveground storage tanks. It further relates to the use of a chime seal and a perforated pipe system, installed around the periphery of the tank bottom plate, to deliver various types of corrosion inhibiting compounds that permeate the spaces above and within a contained substrate area located beneath the tank soil side bottom plate. The tank can also have a ring wall located beneath the tank side wall and a liner located beneath any porous substrate.

A method for retrofitting and protecting a storage tank soil side bottom, comprising the steps of obtaining a storage tank having side walls and a bottom base plate; said bottom base plate having an edge extending outward of said tank side walls, said tank located on a substrate; installing a perforated pipe system around at least a portion of said tank bottom plate edge so that perforations of said pipe system are in communication with said substrate under said tank bottom base plate; installing a chime seal system about at least a portion of said tank bottom base plate edge, said chime seal forming an enclosure for said perforated pipe system, said tank base plate having one or more openings to provide access for said perforated pipe system to said substrate under the tank bottom base plate, said chime seal having one leg contacting said tank base plate; and introducing a corrosion inhibitor into said perforated pipe system so that said corrosion inhibitor is dispersed into said substrate under the said tank bottom base plate.

A retrofitted storage tank soil side bottom, comprising a storage tank having side walls and a bottom base plate; said bottom base plate having an edge extending outward of said tank side walls; said bottom base plate located on a substrate; said substrate being completely hard, or porous, or both and contained within a ring wall, said ring wall located under said tank base plate and below said tank side walls, an impermeable containment liner, said containment liner extending beneath any said porous substrate; a perforated pipe, forming a ring, installed on at least a portion of said bottom base plate edge, wherein said pipe perforations are in communication with area between the underside of said tank base plate and said substrate below said tank base plate; a chime seal located around at least a majority of said tank base plate edge, said chime seal enclosing said perforated pipe, said chime seal having one leg contacting the top side of said tank base plate outer edge and one leg contacting the top side of said substrate outside of the periphery of said perforated pipe ring system; said chime seal having one or more refill ports in communication with said perforated pipe system so that a corrosion inhibitor can be fed to said perforated pipe; and a corrosion inhibitor adapted to be fed into said perforated pipe through said refill ports so that said corrosion inhibitor can be introduced and dispersed through said area between said tank base plate and said substrate below tank base plate.

A soil side storage tank bottom, comprising a storage tank having side walls and a bottom base plate; said base plate extending outward of said side walls; said tank located on a substrate; a chime seal located around at least an external portion of the perimeter of said tank bottom, base plate, said chime seal having one or more openings therein that communicate with said substrate, said chime seal having a leg contacting said tank base plate; a perforated pipe located within said chime seal having at least one perforation and wherein said perforation is in communication with said tank base plate and said substrate; and a corrosion inhibitor adapted to be fed into said perforated pipe so that said corrosion inhibitor is dispersed into said substrate.

A method for protecting a soil side storage tank bottom, comprising the steps of obtaining a storage tank having side walls and a bottom base plate, said base plate extending outward of said side walls, said tank located on a substrate; installing a chime seal around at least an external portion of the perimeter of said tank bottom base plate, said tank bottom base plate having one or more openings therein that communicate with said substrate, said chime having a leg contacting said tank base plate; installing a perforated pipe having at least one perforation within said chime seal wherein said perforation is in communication with said tank base plate and said substrate; and injecting a corrosion inhibitor into said perforated pipe so that said corrosion inhibitor is dispersed into said substrate.

DETAILED DESCRIPTION OF THE INVENTION

Figure 1:
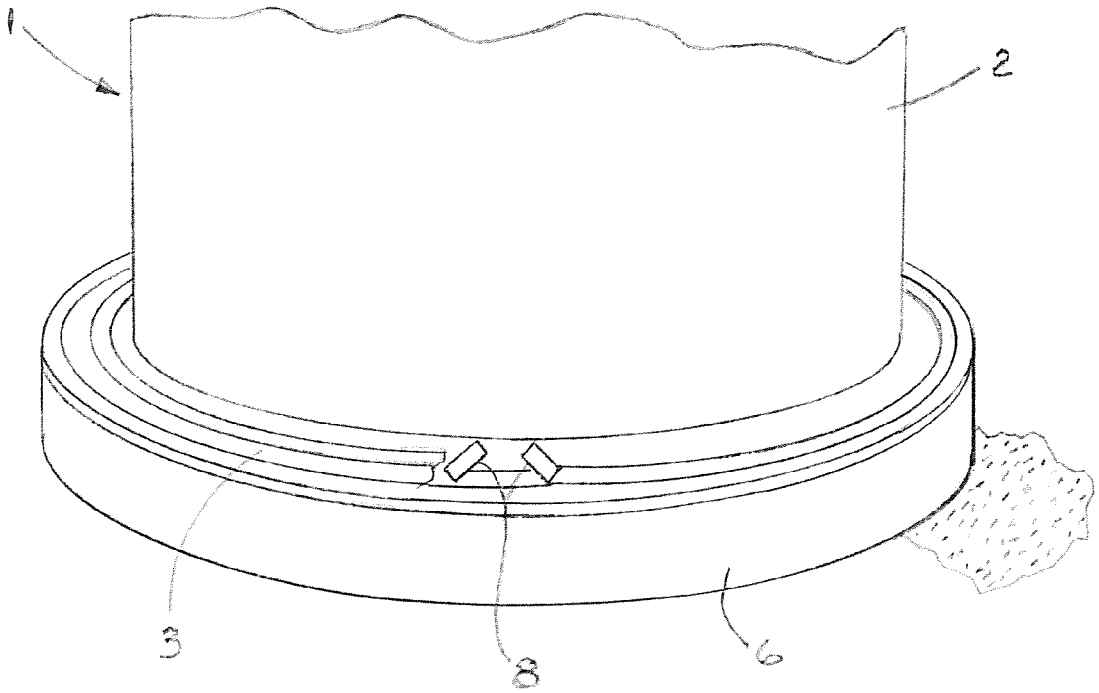
FIG. 1 is a perspective view of the present invention.

Storage tanks 1 have side walls 2 and bottom base plates 7 that inherently are contained or located upon a substrate 6. The bottom base plate extends across the entire bottom of the tank and generally extends outwardly thereof to form an external bottom base plate edge, flange, or annulus 7A. Substrates typically encompass hard surface materials such as concrete and asphalt, etc., either alone or in conjunction with porous materials such as soil, e.g. clay, loam, sandy soils, sand, fine or small-sized stones, pebbles, etc. The external side of the tank bottom plate surface that is situated on or contacts the substrate typically is referred to as the soil side bottom 5. Hard materials or substrates can be located under the entire tank bottom or at least desirably in the vicinity under the tank sides to support the weight thereof. Various porous substrates sometimes referred to as being partially hard can also extend under the entire tank bottom base plate, but it is often desirable that they extend only in the internal tank area as within the tank sides. In this situation, the area beneath the tank side walls will either contain a hard substrate or a ring wall as further set forth herein below. Of course, combinations of hard substrates and porous substrates can be utilized such as concentric ring portions, and the like. Original or natural substrate 15 is typically firm earth such as soil or clay and optionally can be located beneath tank 1 within tank side wall 2 in lieu of porous substrate 6.

The tank soil side bottoms are subject to corrosion during the course of time. The present invention relates to an apparatus and system to protect the tank soil side bottoms 5 with respect to old or existing storage tanks and/or new or installed storage tanks. Corrosion protection of the present system is also achieved through the utilization of various one or more corrosion inhibitors such as water soluble corrosion inhibitors (SCI) and preferably volatile corrosion inhibitors (VCI) to protect tank soil side bottoms 5.

Another important aspect of the present invention that relates to fully protecting tank soil side bottoms from corrosion is the utilization of an inhibitor ring delivery system such as chime seal 3 that extends at least around an external (perimeter) portion of the tank bottom base plate 7 circumference, desirably around a majority of the tank bottom plate circumference, and preferably around the entire tank bottom plate circumference thereof. The chime seal can be plastic, mastic, asphalt, bitumen or elastomer and exists generally on the external edge of the tank bottom base plate or, preferably can be an integral part thereof. Chime seal 3 has at least one refill port 8 that is an opening at the end thereof as shown in FIG. 1, whereby a perforated pipe 4 can be inserted therein. It also serves as an opening into which SCI or VCIs can be added. As explained in greater detail herein below, perforated pipe 9, or in other words the inhibitor ring delivery system, can extend inside the tank chime seal 3 about a portion, desirably around the majority of the tank bottom plate edge or periphery, or preferably extend about the entire periphery thereof. The purpose of the chime seal is to keep moisture, water, etc. out of perforated pipe 4 and keep the corrosion inhibitor in, i.e. trapped under the tank bottom.

Perforated pipe 9 can be made out of any material that is not affected by the corrosion inhibitors and is not degraded by water. Flexible plastics such as thermoplastics and rubbers are thus preferred. The perforated pipe diameter, as well as the sizes, positions and number of the one or more perforations (holes) can vary. For example, using a 1-inch diameter pipe, one or two rows of perforations are typically used. If two rows are used, the rows are typically positioned at 180° of arc. The perforations are typically round, in the range of 0.25-inch diameter, but can also be oblong or slotted, and spaced in the range of 2 inches apart.

It is important that perforated pipe holes 9 be in communication with the substrate so that corrosion inhibitors admitted or injected therefrom can permeate the substrate and contact the soil side of the tank bottom plate to protect the same from corrosion. The term "communication" is defined here are meaning there are pathways, channels, openings, and the like for the corrosive inhibitor to be introduced into the area formed between the substrate, the tank soil side bottom and the chime seal.

Additional advantages of the corrosion inhibitor delivery systems for tank soil side bottoms are that it is very convenient to supply various corrosion inhibitors to the substrate area, that one or more different corrosion inhibitors can be utilized, that the corrosion inhibitors can be applied at any desired time and duration, and that the corrosion inhibitors can be replenished in the inhibitor ring delivery system without disruption to tank operations. Inhibitor replenishment can be performed when needed and can be controlled manually, automatically with respect to certain times and duration thereof, or automatically upon receiving feedback as from sensors, etc.

Figure 2:
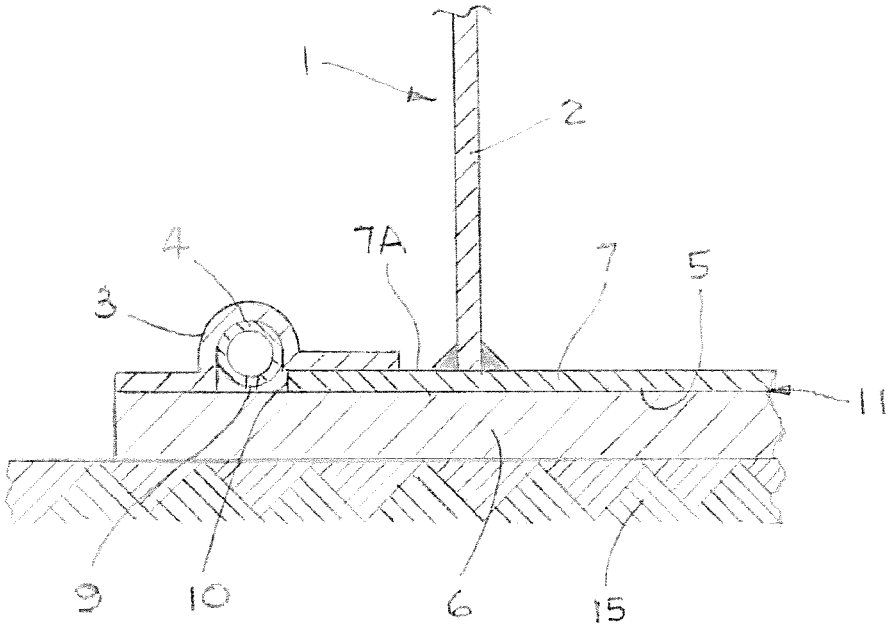
FIG. 2 is a cross-section side elevation view of FIG. 1.
Figure 3:
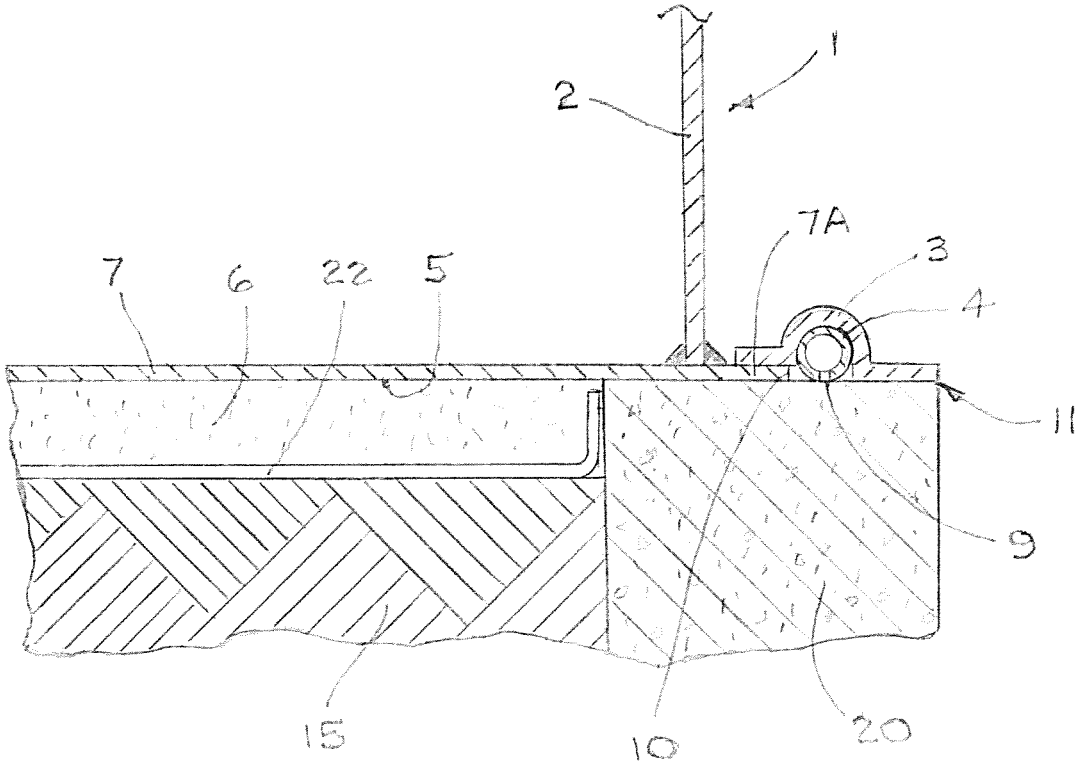
FIG. 3 is a cross-section side elevation view of an embodiment containing a ring wall and a liner.

Reference is now made to a specific embodiment as set forth in FIGS. 1-3 by way of example and that the scope of the invention is not limited thereto in as much as many other embodiments, examples and figures do exist within the metes and bounds of the present invention.

FIGS. 1 and 2 show an embodiment of a tank 1 having sides 2 and bottom base plate 7 wherein a chime seal 3 is utilized to encapsulate or house a perforated pipe 4 that is in communication with tank soil side bottom 5 and generally the substrate 6. The chime seal has one leg that resides upon a hard surface portion of substrate 6, for example, concrete or asphalt, that extends outwardly of the periphery of the perforated pipe 4, and chime seal 3 optionally has another leg that resides upon the top surface of the outward extending tank base plate edge 7A. Both legs of the chime are sealed. The delivery system relates to various one or more corrosion inhibitors being supplied in a permeable casing, not shown, through refill port 8 that is connected to an end of perforated pipe 4, which has perforations 9 positioned such that the corrosion inhibitor is allowed to communicate with tank soil side bottom 5. Chime openings 10 and the perforated pipe end openings are desirably located adjacent to one another. Upon delivery of one or more corrosion inhibitors through ports 8 into perforated pipe 4, the same will flow through pipe 4 and flow out of perforations 9. Due to the fact that both the top surface of substrate 6 and the tank soil side bottom surface 5 are never even, but contain undulations and openings therein, the corrosion inhibitor can flow underneath tank baseplate edge or annulus 7A and baseplate 7 and flow toward the center of the tank soil side bottom. That is, chime seal 3 acts to confine the corrosion inhibitor to the void space 11 under tank bottom plate 7 whereupon it contacts and/or coats the tank soil side bottom 5 and forms a protective corrosion inhibitor surface thereon.

As known to those skilled in the art, the bottom of the storage tank performs a breathing action due to slight movement of the tank bottom with respect to filling and entering operations, draining operations, temperature, and the like. Due to these inherent breathing aspects, the corrosion inhibitors are drawn or pulled into the small open or void areas 11 beneath tank bottom plate 5. As with the other embodiments, the corrosion inhibitors can even be soluble inhibitors, generally not preferred, volatile corrosion inhibitors, which are preferred, or a mixture thereof, which is also preferred.

An important aspect of the present invention is that it is essentially or preferably free of any perforated pipe or similar embodiments that extend to substrate area 6 located beneath tank 1 generally within side walls 2. Thus, there is no need to drill or dig into substrate area 6 to install perforated pipes therein. An advantage of the same is that expensive construction and/or installation costs are eliminated. Other advantages are similar to those set forth above and the fact that the corrosion inhibitors can be replenished as needed, automatically, or by any other system as described herein above. Another advantage is that the present invention is ideally suited for storage tanks wherein the void space or volume between the tank bottom and substrate are small.

The inhibitors can be applied in solid form or in liquid form.

With respect to soluble corrosion inhibitors, they include, but are not limited to, mixtures of $ZnSO_4$ and $NaH_2PO_4$, organic nitrites, imidazoles and organic aminophosphites. Suitable solvents for such soluble corrosion inhibitors include, but are not limited to, aqueous solutions including those of sodium, potassium, and calcium compounds, or mixtures of two or more thereof. The strength and/or concentration of such aqueous solvents will depend, in part, upon the amount of soluble corrosion inhibitor to be dissolved therein. Accordingly, the present invention is not limited to any one set of strengths and/or concentrations of solvents for the soluble corrosion inhibitors disclosed herein. Suitable sodium and calcium compounds for use in forming the above-mentioned aqueous solvents include, but are not limited to, $Na_2MoO_4$, $Na_3PO_4$, $NaH_2PO_4$, $NaNO_2$, $Na_2SiO_3$, calcium phosphonate, or suitable mixtures of two or more thereof. In another instance, corresponding potassium compounds can be used in place of the above-mentioned sodium compounds. In another embodiment, the one or more soluble corrosion inhibitors of the present invention are powders in granular form. However, the present invention is not limited to only the above-mentioned forms.

In connection with the present invention, suitable VCI compounds for use in connection with the present invention are known in the art and, as such, any suitable volatile or vapor phase corrosion inhibitors can be used in the rust-resistant perforated pipes of the present invention. Suitable VCIs for use in the present invention are disclosed in U.S. Pat. Nos. 4,290,912; 5,320,778; and 5,855,975, which are incorporated by reference in their entirety for their teachings of such compounds. Examples of VCIs set forth in U.S. Pat. No. 4,290,912 include inorganic nitrite salts including metal nitrites, preferably Group I and II metal nitrites such as potassium nitrite, sodium nitrite, barium nitrite, and calcium nitrite. Examples of VCIs set forth in U.S. Pat. No. 5,320,778 include anhydrous sodium molybdate [$Na_2MoO_4$], anhydrous ammonium dimolybdate [$(NH_4)_2MoO_4$], or an anhydrous amine-molybdate. The preferred amine molybdates of this component of the composites of the present invention are amine-molybdates comprising dicyclohexylamine, 2-ethylhexylamine, and cyclohexylamine. Another group of VCIs comprise amine benzoates, amine nitrates, and benzotriazole. Other VCIs comprise cyclohexylamine benzoate, ethylamine benzoate, dicyclohexylamine nitrate and benzotriazole. Examples of VCIs set forth in U.S. Pat. No. 5,855,975 include sodium nitrite and benzotriazole. Useful volatile or vapor phase corrosion inhibitors also include but are not limited to, benzotriazole, tolytriazole and salts thereof, mixtures of benzoates of amine salts with benzotriazole, nitrates of amine salts, and $C_{13}H_{26}O_2N$.

FIG. 3 relates to an embodiment of the present invention somewhat similar to the embodiments of FIGS. 1 and 2 but additionally contains a ring wall. As shown in FIG. 3, tank 1 contains a sidewall 2 that is located on tank base plate 7 that extends the entire diameter or width of the tank and has a slight exterior circumferential annulus or edge that extends readily outward of the tank side wall. Chime seal 3 is desirably located in the vicinity of the outer end of bottom exterior edge 7A and the top of ring wall 20 as shown in FIG. 3. Although not shown, the chime seal contains refill ports that allow perforated pipe 4 to be inserted therein and subsequently various one or more SCI and/or one or more VCI compounds. Such compounds, as noted above, will flow through perforated pipe 4 enclosed within chime seal 3 and exit desirably at the bottom portion thereof through perforations 9 so that they can enter void spaces 11 inherently located under tank soil side bottom 5 and flow radially inwardly toward the center of the tank. In this embodiment, ring wall 20, instead of being located on a hard substrate surface such as asphalt or concrete, is located below tank side wall 2 so that it can support the same. Ring wall 20, of course, is made of a hard material, usually concrete or the like, and extends downward into the ground beneath tank 1 thus forming a cylinder. Substrate 6 located within ring wall 20, as noted above, can either be hard, for example concrete or asphalt, or porous such as sand, small stones such as pebbles, actual soil such as clay, loam or a sandy soil, and the like. In the embodiment of FIG. 3, the substrate located radially inward of ring wall 20 is sand wherein the same was placed there prior to the installation of the tank. In order to prevent the SCI and/or VCI from penetrating sand substrate 6 and permeating down into the ground or soil underneath the ring wall and laterally (radially outwardly) exiting therefrom, liner 22 is utilized under porous substrate 6. The liner desirably is a polymer or other non-corrosive material that is generally impermeable with regard to the SCI and/or VCI compounds. Suitable plastics include PVC, polyolefins such as polyethylene, and polyurethanes. Alternatively, liner 22 can be located under the entire tank base plate or any portion thereof.

While in the embodiment of FIG. 3, a porous substrate is utilized within ring wall cylinder, other embodiments exist. For example, interior substrate 6 can be a hard material that extends across the entire area within ring wall 20, or it can extend partially into the inner tank area, as say a few or several inches, or to any extent therebetween. Conversely, the remaining non hard area can be a porous area. Another embodiment of FIG. 3 is that the substrate located radially outward the ring wall 20 can be hard.

While in accordance with the Patent Statutes, the best mode and preferred embodiments have been set forth, the scope of the invention is not limited thereto, but rather, by the scope of the attached claims.

What is claimed is:

1. A retrofitted storage tank soil side bottom, comprising:

a storage tank having side walls and a bottom base plate; said bottom base plate having an edge extending outward of said tank side walls; said bottom base plate located on a substrate; said substrate being completely hard, or porous, or both and contained within a ring wall, said ring wall located under said tank base plate and below said tank side walls, an impermeable containment liner, said containment liner located beneath any said porous substrate;

a pipe having perforations therein forming a ring installed on at least a portion of said bottom base plate edge, wherein said pipe perforations are in communication with area between an underside of said tank base plate and said substrate below said tank base plate;

a chime seal located around at least a majority of said tank base plate edge, said chime seal enclosing said perforated pipe, said chime seal having one leg contacting the top side of said tank base plate outer edge and another leg contacting the top side of said substrate outside of the periphery of said perforated pipe ring system;

said chime seal having one or more refill ports in communication with said perforated pipe so that a corrosion inhibitor can be fed to said perforated pipe; and a corrosion inhibitor adapted to be fed into said perforated pipe through said refill ports so that said corrosion inhibitor can be introduced and dispersed through said area between said tank base plate and said substrate below tank base plate.

2. A storage tank bottom according to claim 1, wherein said chime seal extends entirely around said perimeter of said tank;

wherein said perforated pipe extends around the entire perimeter of said tank bottom; and wherein said chime opening and said pipe perforations are located adjacent to each other.

3. A storage tank bottom according to claim 2, wherein said corrosion inhibitor is a soluble inhibitor, or wherein said corrosion inhibitor is a volatile corrosion inhibitor, or both.

4. A storage tank bottom according to claim 3, wherein said hard substrate is concrete or asphalt.

5. A storage tank bottom according to claim 1, wherein said storage tank bottom is a new storage tank bottom, or wherein said storage tank bottom is an existing tank bottom.

6. A method for retrofitting and protecting a storage tank soil side bottom, comprising the steps of:

obtaining a storage tank having side walls and a bottom base plate; said bottom base plate having an edge extending outward of said tank side walls, said tank located on a substrate;

installing a perforated pipe system around at least a portion of said tank bottom plate edge so that perforations of said pipe system are in communication with said substrate under said tank bottom base plate;

installing a chime seal system about at least a portion of said tank bottom base plate edge, said chime seal forming an enclosure for said perforated pipe system, said tank base plate having one or more openings to provide access for said perforated pipe system to said substrate under the tank bottom base plate, said chime seal having one leg contacting said tank base plate; and introducing a corrosion inhibitor into said perforated pipe system so that said corrosion inhibitor is dispersed into said substrate under the said tank bottom base plate.

7. The method of claim 6, wherein said chime seal extends entirely around said tank bottom plate edge, and wherein said perforated pipe extends around said tank bottom plate edge.

8. The method of claim 7, wherein said chime openings and said pipe perforations are located adjacent to each other, and wherein said corrosion inhibitor is a soluble inhibitor, or wherein said corrosion inhibitor is a volatile corrosion inhibitor, or both.

9. The method of claim 8, wherein said substrate is concrete or asphalt.

10. The method of claim 6, wherein said storage tank bottom is a new storage tank bottom, or wherein said storage tank bottom is an existing tank bottom.

11. A soil side storage tank bottom, comprising:

a storage tank having side walls and a bottom base plate; said base plate extending outward of said side walls; said tank located on a substrate;

a chime seal located around at least an external portion of the perimeter of said tank bottom base plate, said chime seal having one or more openings therein that communicate with said substrate, said chime seal having a leg contacting said tank base plate;

a perforated pipe located within said chime seal having at least one perforation and wherein said perforation is in communication with said tank base plate and said substrate; and a corrosion inhibitor adapted to be fed into said perforated pipe so that said corrosion inhibitor is dispersed into said substrate.

12. A soil side storage tank bottom according to claim 11, wherein said tank bottom base plate is a new tank bottom or an old tank bottom base plate; and wherein said corrosion inhibitor is a soluble corrosion inhibitor, a volatile corrosion inhibitor, or both.

13. A storage tank bottom according to claim 12, wherein said chime seal extends entirely around said perimeter of said tank base plate, wherein said perforated pipe extends entirely around the perimeter of said tank base plate, wherein said chime seal contains a plurality of openings therein, wherein said perforated pipe contains a plurality of perforations therein, wherein said chime seal openings and said perforated pipe perforations are located adjacent to each other, including another chime seal leg contacting said substrate, and wherein said corrosion inhibitor is a volatile corrosion inhibitor, a soluble corrosion inhibitor or both.

14. A storage tank bottom according to claim 12, wherein at least a portion of said substrate is porous, and including a liner, said liner located under said porous substrate portion.

15. A storage tank bottom according to claim 14, wherein a portion of said substrate is a hard substrate located beneath said tank side wall, and wherein said substrate located radially inward of said hard substrate is porous, and including a liner, said liner located below said porous substrate.

16. A method for protecting a soil side storage tank bottom, comprising the steps of:

obtaining a storage tank having side walls and a bottom base plate, said base plate extending outward of said side walls, said tank located on a substrate;

installing a chime seal around at least an external portion of a perimeter of said tank bottom base plate, said tank bottom base plate having one or more openings therein that communicate with said substrate, said chime having a leg contacting said tank bottom base plate;

installing a perforated pipe having at least one perforation within said chime seal, wherein said perforation is in communication with said tank base plate and said substrate; and injecting a corrosion inhibitor into said perforated pipe so that said corrosion inhibitor is dispersed into said substrate.

17. The method of claim 16, wherein said tank bottom base plate is a new tank bottom or an old tank bottom base plate, and wherein said corrosion inhibitor is a soluble corrosion inhibitor, a volatile corrosion inhibitor, or both.

18. The method of claim 17, wherein said chime seal extends entirely around said perimeter of said tank bottom base plate, wherein said perforated pipe extends entirely around the perimeter of said tank bottom base plate, wherein said chime seal contains a plurality of openings therein, wherein said perforated pipe contains a plurality of perforations therein, wherein said chime openings and said perforated pipe perforations are located adjacent to each other, including another chime seal leg contacting said substrate, and wherein said corrosion inhibitor is a volatile corrosion inhibitor.

19. The method of claim 17, wherein said substrate is concrete or asphalt.

20. The method of claim 16, wherein a portion of said substrate is a hard substrate located beneath said tank side wall and wherein the remaining portion of said substrate is porous, and including a liner, said liner located under said porous substrate.

* * * * *

UNITED STATES PATENT AND TRADEMARK OFFICE

CERTIFICATE OF CORRECTION

PATENT NO. : 9,303,380 B2
APPLICATION NO. : 14/514505
DATED : April 5, 2016
INVENTOR(S) : Efim Ya Lyublinski et al.

It is certified that error appears in the above-identified patent and that said Letters Patent is hereby corrected as shown below:

Specification

Column 4, line 4, replace "perforated pipe 9" with --perforated pipe 4--

Column 4, line 12, replace "Perforated pipe 9" with --Perforated pipe 4--

Signed and Sealed this
Twelfth Day of July, 2016

Michelle K. Lee

Michelle K. Lee
*Director of the United States Patent and Trademark Office*